US008683749B2

(12) United States Patent
Fontes et al.

(10) Patent No.: US 8,683,749 B2
(45) Date of Patent: Apr. 1, 2014

(54) COOLING TOWER ENTRY DOOR STRUCTURE

(75) Inventors: Trevor Fontes, Baltimore, MD (US); Lukasz Sztobryn, Hanover, PA (US); Justin K Peters, Laurel, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 467 days.

(21) Appl. No.: 13/065,629

(22) Filed: Mar. 25, 2011

(65) Prior Publication Data

US 2012/0240471 A1 Sep. 27, 2012

(51) Int. Cl.
*E04B 2/82* (2006.01)

(52) U.S. Cl.
USPC ..... 52/29; 52/32; 52/126.4; 52/205; 220/629; 248/125.1; 49/404

(58) Field of Classification Search
USPC ..... 248/157, 125.1, 125.8, 161, 407, 213.1; 49/404, 426, 456; 220/629, 628; 52/29, 52/32, 126.4, 205
See application file for complete search history.

(56) References Cited

U.S. PATENT DOCUMENTS

| | | | | |
|---|---|---|---|---|
| 252,401 | A | 1/1882 | Stauffer | |
| 1,061,658 | A | 5/1913 | Bradshaw et al. | |
| 1,264,417 | A | 4/1918 | Matson | |
| 2,108,697 | A * | 2/1938 | Van Atta | 160/374 |
| 2,276,139 | A * | 3/1942 | Anderson et al. | 454/331 |
| 2,661,677 | A * | 12/1953 | Lingelbach | 454/331 |
| 2,776,811 | A * | 1/1957 | Shaffer | 248/542 |
| 2,949,948 | A * | 8/1960 | Zern | 144/371 |
| 2,984,417 | A | 5/1961 | Voorhees | |
| 3,398,933 | A | 8/1968 | Haroldson | |
| 3,451,153 | A * | 6/1969 | Dohanyos | 40/741 |
| 3,603,552 | A | 9/1971 | Wheelock | |
| 4,319,431 | A * | 3/1982 | Siers | 49/426 |
| 4,608,800 | A * | 9/1986 | Fredette | 52/656.1 |
| 4,625,476 | A * | 12/1986 | Shimada | 52/126.4 |
| 4,631,881 | A * | 12/1986 | Charman | 52/220.7 |
| 4,709,517 | A * | 12/1987 | Mitchell et al. | 52/36.6 |
| 5,253,839 | A * | 10/1993 | McClure | 248/354.1 |
| 5,297,779 | A | 3/1994 | Collins, Jr. et al. | |
| 5,381,994 | A * | 1/1995 | Welch | 248/346.01 |
| 5,386,674 | A * | 2/1995 | Sfirakis et al. | 52/243.1 |
| 5,400,993 | A * | 3/1995 | Hamilton | 248/279.1 |
| 5,595,028 | A * | 1/1997 | Handzlik | 52/32 |

(Continued)

FOREIGN PATENT DOCUMENTS

| | | | | |
|---|---|---|---|---|
| EP | 839477 A2 * | 5/1998 | | A47B 91/02 |
| EP | 976890 A2 * | 2/2000 | | E04F 21/00 |

(Continued)

*Primary Examiner* — Joshua J Michener
*Assistant Examiner* — Charissa Ahmad
(74) *Attorney, Agent, or Firm* — Edward J. Brosius

(57) ABSTRACT

An adjustable support assembly is provided that includes a front left base support, a front left lower elongated support and a front left upper elongated support. Also included are a front right base support, a front right lower elongated support, and a front right upper elongated support. Such supports are designed to be placed in a structural wall, particularly the structural wall of the cooling tower, wherein an opening would be cut in the wall to receive an entry door. The support assembly provides structural integrity from the lower section of the cooling tower to the upper section of the cooling tower, and allows the door opening to be cut out without loss of such structural integrity.

18 Claims, 5 Drawing Sheets

(56) References Cited

U.S. PATENT DOCUMENTS

| | | | | |
|---|---|---|---|---|
| 5,797,568 | A * | 8/1998 | Canton Gongora et al. | 248/122.1 |
| 5,806,258 | A * | 9/1998 | Miedema et al. | 52/220.7 |
| 6,330,773 | B1 * | 12/2001 | MacDonald et al. | 52/239 |
| 6,729,083 | B1 * | 5/2004 | Soyko | 52/220.8 |
| 6,863,253 | B2 * | 3/2005 | Valentz et al. | 248/519 |
| 7,146,774 | B2 * | 12/2006 | Fredette | 52/656.6 |
| 7,673,427 | B2 * | 3/2010 | Morey | 52/220.8 |
| 7,717,290 | B2 * | 5/2010 | Gerding | 220/629 |
| 8,069,598 | B2 * | 12/2011 | Garcia et al. | 40/601 |
| 8,261,509 | B2 * | 9/2012 | Harkin | 52/645 |
| 8,276,864 | B2 * | 10/2012 | Ye et al. | 248/287.1 |
| 2009/0084923 | A1 * | 4/2009 | Lin | 248/407 |
| 2009/0094896 | A1 * | 4/2009 | Quick et al. | 49/55 |
| 2011/0089310 | A1 * | 4/2011 | Heintz | 248/677 |
| 2013/0081336 | A1 * | 4/2013 | Rasmussen | 52/29 |

FOREIGN PATENT DOCUMENTS

| | | | | |
|---|---|---|---|---|
| GB | 2097195 | A * | 10/1982 | H01Q 1/12 |
| JP | 2007169962 | * | 7/2007 | |
| JP | 2008190204 | A * | 8/2008 | |
| JP | 2009052240 | A * | 3/2009 | |

* cited by examiner

COOLING TOWER ENTRY DOOR STRUCTURE

BACKGROUND OF THE INVENTION

The present invention relates to an adjustable support assembly and, more particularly, to an adjustable support assembly designed to be placed in the wall of a cooling tower to allow an access door opening to be cut into such wall without loss of structural integrity.

Cooling towers or heat exchangers are typically comprised of fabricated sections made of sheet metal, with such sections typically being stacked on top of each other. For example, a cooling tower could comprise a lower structural section wherein fill would be placed to allow direct evaporation of water passing over the fill. An indirect cooling tower section could be placed on top of the fill containing section and contain a series of coils for indirect cooling of a fluid passing through the coils. Accordingly it is seen that the bottom or lower structural section of such cooling tower must support significant weight.

It is desirable in cooling towers to have an access door whereby maintenance personnel can enter the cooling tower for access to the internal components such as the fill, the indirect coil section, and the fan and motor assembly whereby air is forced or drawn into and across the fill and coil assembly. Such access door assemblies are restricted in their size and design by the necessary weight supporting needs, especially of the bottom cooling tower section. Further, such cooling towers come in various sizes whereby a bottom section of a cooling tower could be between six and fourteen feet in width, and six and eighteen feet in length, and between six and eight or ten feet in height. With such a large sheet metal structure, and with the necessary weight constraints in the design and construction of a cooling tower, the walls of the cooling tower structure, while comprised on sheet metal, need to be designed to support the necessary weight while being as light as possible.

With the need for an access door in both newly designed and especially existing cooling towers which may have a relatively small access opening that may not allow equipment to be brought through the access opening and barely allow the access by a maintenance worker, it is desirable to allow the retrofitting of existing cooling towers especially with a larger access door. With the necessary cutting and removal of the structural wall to enlarge the access opening and install an appropriate door, there is an inherent loss of potential structural support in the wall, especially of the lower cooling tower section.

Accordingly, it is an object of the present invention to provide an adjustable support assembly that allows a larger access opening to be placed in an existing cooling tower, or even in a newly constructed cooling tower, while providing necessary support above the lower cooling tower section in which the access door and adjustable support assembly is installed.

Further it is an object of the present invention to provide an adjustable support assembly that is almost universally applicable to various sizes of cooling tower walls.

SUMMARY OF THE INVENTION

The present invention provides an adjustable support assembly for use in a metal structure to allow the installation of an access door requiring an access opening.

The adjustable support assembly of the present invention is especially useful in sheet metal structures such as cooling towers or heat exchangers that utilize structural components such as an indirect heat exchange section including coil assemblies and a direct cooling section including a fill material. Typically, the access door is required in the lower of two such cooling tower structural components which would be stacked vertically on top of each other. The access door would typically be in the of lower of such component sections, with the concern being that if an access door is large enough to allow the ready access of the maintenance worker with appropriate replacement equipment such as motors, belts, and fill sections, the size of the access opening would result in a decreased support capability of the lower component section.

Accordingly, the adjustable support assembly of the present invention allows an adequate size access opening to be retrofit into an existing cooling tower, or placed in a newly constructed cooling tower, and have the lower component of the cooling tower maintain its structural integrity to allow either it to stand of its own accord or indeed to support a second cooling tower component on top of it.

The adjustable support assembly of the present invention in general comprises two elongated support assemblies, each comprising a base support, a lower elongated support, and an upper elongated support. The upper elongated support would be affixed to the cooling tower structural wall, while the lower elongated support would have its bottom section affixed to the base support. With the interconnecting design of the elongated lower and upper elongated supports, such supports are vertically adjustable in relation to each other. A typical design for such elongated supports would be a channel type design wherein the upper elongated support would fit inside the lower elongated support. Of course other designs of vertical adjusting support components such as closed channels, angles, and other structural components is possible.

Such elongated supports include a plurality of bolt receiving openings or threaded fastener receiving openings that when the upper support is vertically adjusted within the lower support, such openings can be aligned and threaded fasteners placed therein to provide significant vertical expansion and adjustment to make the support assembly applicable to a large variety of sizes of cooling tower component structures.

Further, the bottom of the lower elongated support is affixed to a base support in a vertically adjustable fashion, usually by the use of a threaded fastener and nut assembly, such that accurate adjustments of the height of the interacting elongated supports are possible.

On the inside of the cooling tower structure, a rear hinge support and a rear locking support are installed in cooperation with the elongated supports on the front side of the cooling tower, and on either side of the access opening. A door is hung from hinges placed on the hinge support, and appropriate locking or handle turning mechanisms can be installed on the side of the door adjacent the locking support.

Further, a front top support extends laterally between both front elongated supports. A rear top support extends laterally between the top of the rear hinge support and the rear locking support.

DETAILED DESCRIPTION

Figure 1:
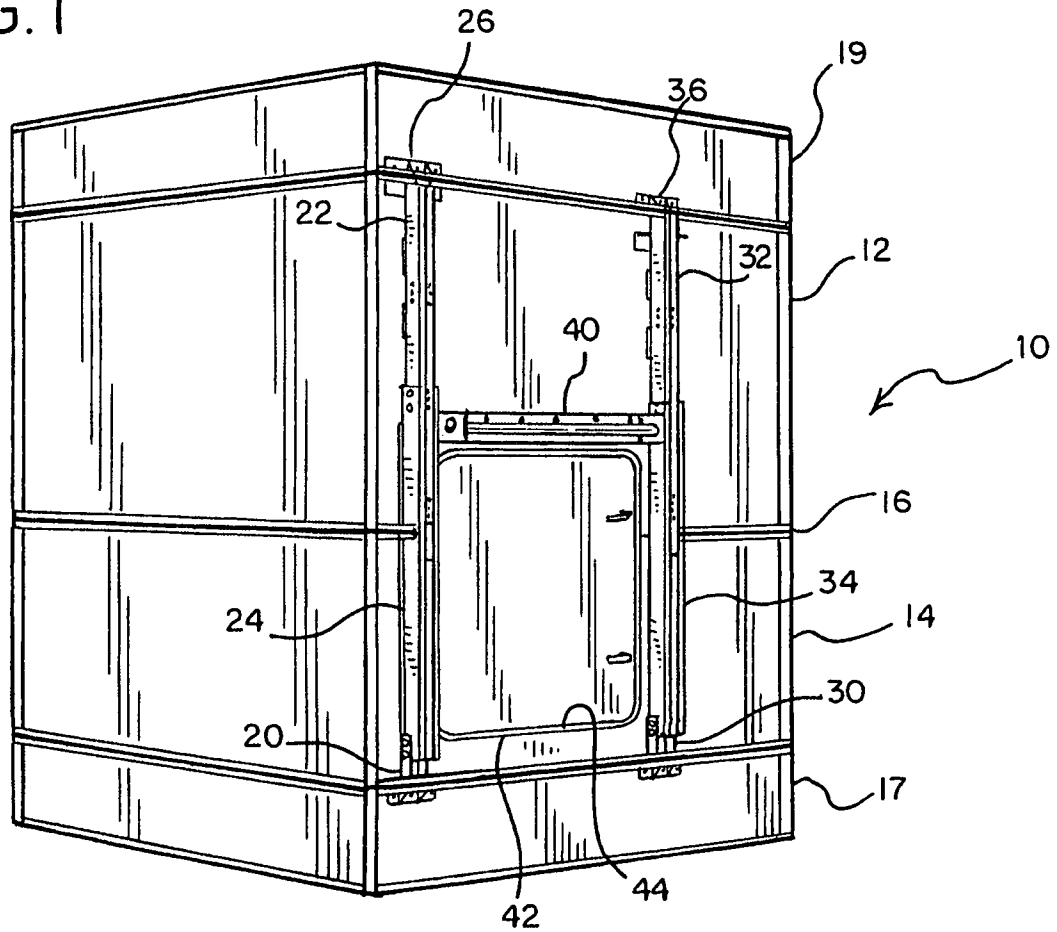
FIG. 1 is a perspective view of an adjustable support assembly in accordance with an embodiment of the present invention.
Figure 3:
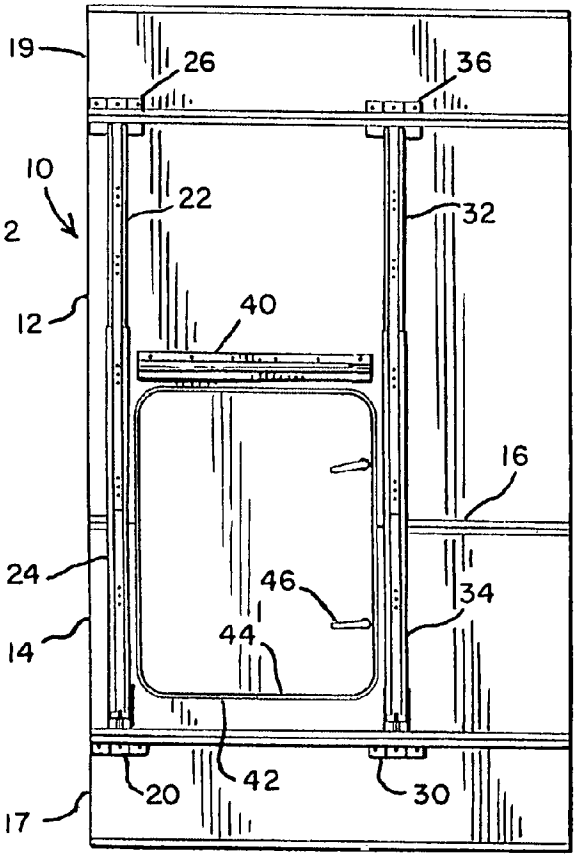
FIG. 3 is a front view of an adjustable support assembly in accordance with an embodiment of the present invention.
Figure 2:
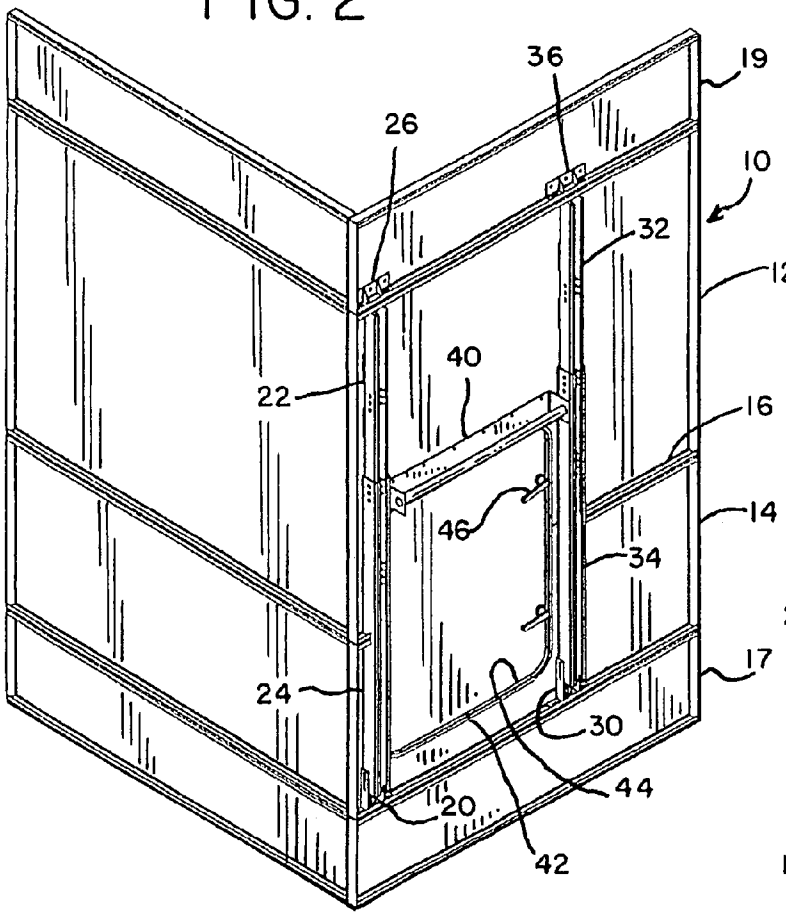
FIG. 2 is a perspective view of an adjustable support assembly in accordance with an embodiment of the present invention.

Referring now to FIG. 1-FIG. 3 of the drawings, a cooling tower structural unit is shown generally at 10. Such structural unit is generally comprised of an upper section 12, a lower section 14, which is supported on a bottom section 17, with a top section 19 on top of upper section 12. All such sections are usually comprised of sheet metal, which is usually galvanized or possibly even stainless steel. Junctions 16 are located between upper section 12 and lower section 14, and extend for the entire circumference of cooling tower 10. Such junction include structural turnouts to allow the component sections to be joined to each other, and generally lend strength and rigidity to the cooling tower structure 10 itself. Cooling tower component section 10 can vary in size from a width of six feet and a length of six feet and a height of approximately eight feet to a unit having a width of up to fourteen feet and a corresponding length, with a height of ten or twelve feet.

Cooling tower component section 10 can comprise direct cooling components such as fill wherein water is allowed to flow downwardly across such fill and directly evaporate. Such cooling tower or heat exchange sections are generally deemed direct cooling components. A similar cooling tower section 10 can be located on top of cooling tower component section 10 and an indirect cooling section comprised of multiple serpentine tubes wherein a fluid to be cooled flows and is subjected to a flow of water on the outside of such tubes. Such cooling tower component section is generally deemed an indirect cooling section. As expected, such a cooling tower component section can have significant weight, and thereby cooling tower component section 10 is required to provide necessary support for such cooling tower section located on top of cooling tower component section 10.

Accordingly, when an access door 42 is located in a structural wall of cooling tower component section 10, there is need to provide adequate structural support for both cooling tower section 10 itself and any cooling tower section component located on top of cooling tower component section 10. Accordingly, an adjustable support assembly is provided whereby an access door can be retrofit into an existing cooling tower, or designed into a newly constructed cooling tower. Such adjustable support assembly comprises front left base support 20, front left upper elongated support 22, front left lower elongated support 24, and front left top support 26.

Adjustable support assembly also comprises front right base support 30, front right upper elongated support 32, front right lower elongated support 34, and front right top support 36.

Door 42 itself is seen to close into door opening 44.

Front top support 40 is also seen to extend laterally between an upper portion of front left lower elongated support 26 and front right lower elongated support 34.

In the embodiment shown, front left upper elongated support is affixed to upper section 12 being a structural wall of cooling tower 10, as is front right upper elongated support 32 affixed to the outside of the structural wall of upper section 12 of cooling tower component section 10. Such joining is usually accomplished by bolting, but can be accomplished by welding or other affixation means.

Referring now FIG. 4-FIG. 10, the retrofitting of an existing cooling tower component section 10 is shown in usual sequential steps, with the understanding that these steps may be modified and still be considered part of the present invention. Front left base support 20 is seen to be affixed in FIG. 4 to a location downward in as facing left of existing or initial door opening 45. In this situation, it is desired to expand the initial door opening 45 to a more readily usable and accessible larger opening, which would be equivalent to door opening 44 as shown in FIG. 1. Front left upper elongated support 22 is seen to be affixed to upper section 12 of cooling tower 10. Further, lower elongated support 24 is seen to be fitted around front left upper elongated support 22 in a manner that lower elongated support 24 is movable in relation to front left upper elongated support 22. Such movement allows the combined elongated support structure to meet and be fitted to virtually any size cooling tower component structure 10. Front left lower elongated support 24 is seen to extend downwardly and engage front left base support 20.

Figure 5:
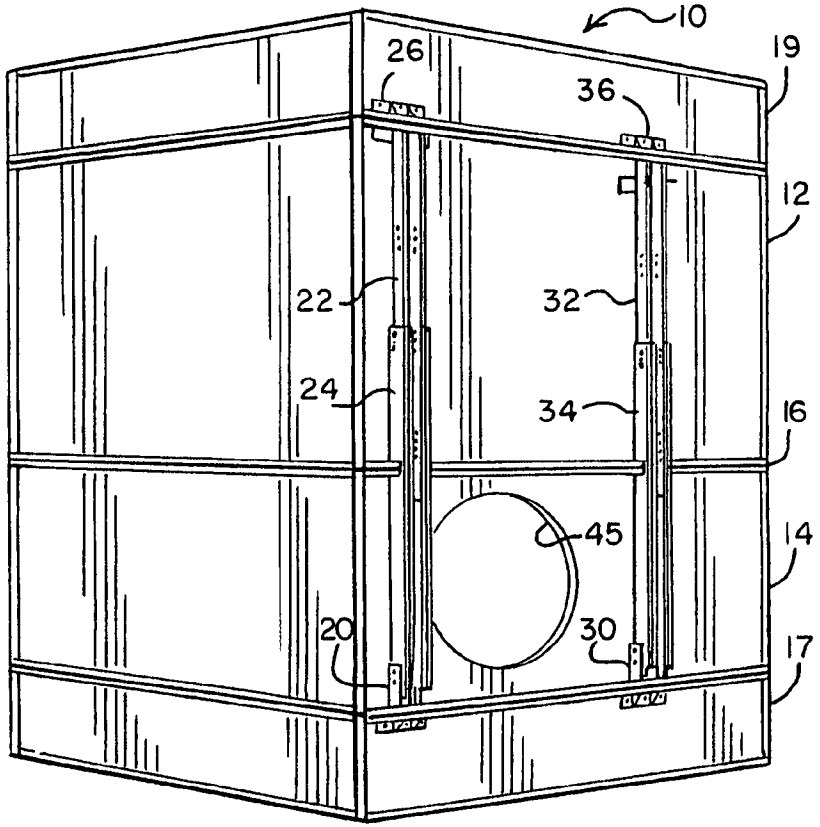
FIG. 5 is a perspective view of a second step in accordance with installing an adjustable support assembly in accordance with an embodiment of the present invention.
Figure 4:
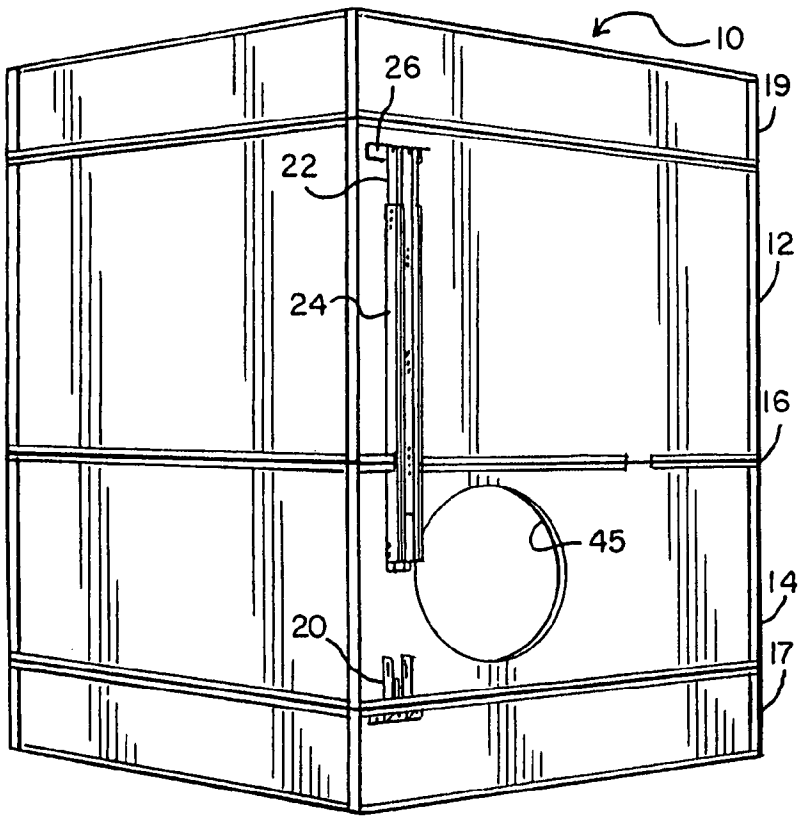
FIG. 4 is a perspective view of an initial step in installing the adjustable support assembly of one embodiment of the present invention.

Referring now to FIG. 5, the front right upper elongated support 32, and front right lower elongated support 34, along with front right base support 30 are seen to be similarly applied to the outer surface of cooling tower component 10 bridging between upper section 12 and lower section 14. It should be understood that front left upper elongated support 22 and front left lower elongated support 24, and similarly front right upper elongated support 32 and front right lower elongated support 34 can be comprised of a structural steel channel assembly, or an angle assembly or other structural component to allow a complementary fit between such elongated support components that allows the elongated support components to be extended in relation to each other as the need to fit cooling tower component section 10 depending on its size varies.

Figure 6:
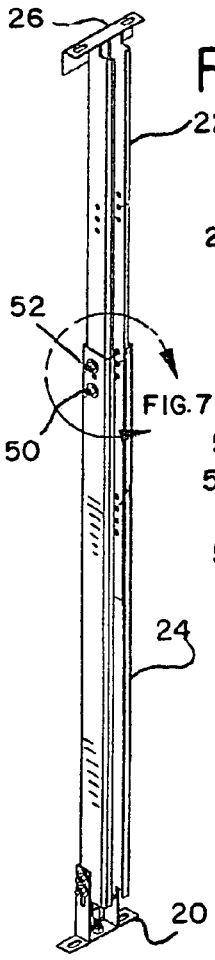
FIG. 6 is a detailed view of a lower elongated support and an upper elongated support in accordance with an embodiment of the present invention.
Figure 7:
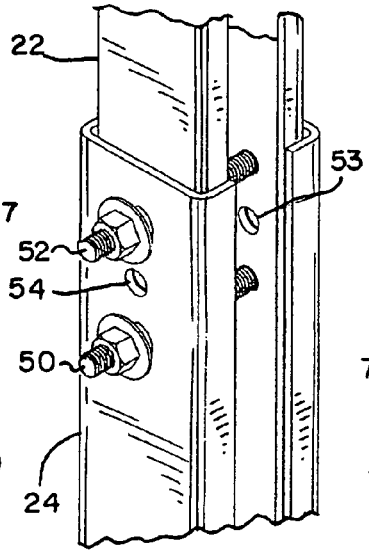
FIG. 7 is a detailed view of threaded fasteners passing through aligned openings in a lower elongated support and an upper elongated support in accordance with an embodiment of the present invention.

Referring now to FIG. 6 and FIG. 7, a detailed view of front left upper elongated support 22 is shown having plurality of bolt holes 53 therein and front left lower elongated support 24 is shown having a plurality of bolt holes 54 extending there through. As can be seen, front left upper elongated support 22 extends into front left lower elongated support 24 allowing vertical adjustment and extension there between as needed to adapt the support structure to any size cooling tower component 10. Threaded fastener assemblies 50 and 52 extend between aligned openings 53 and 54 with such threaded fasteners usually comprising machine bolts nuts and washers.

Figure 10:
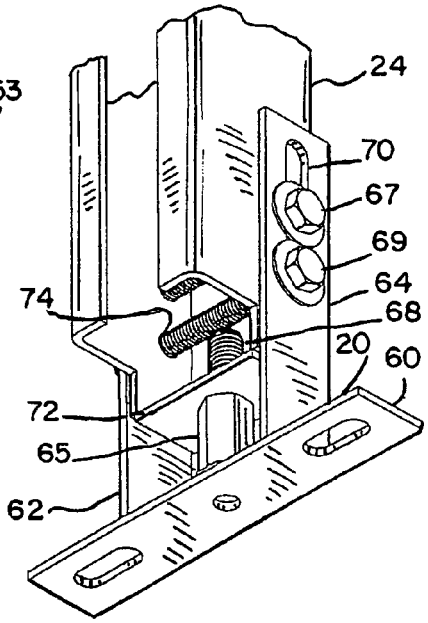
FIG. 10 is a detailed perspective view of a lower elongated support received in a base support.
Figure 8:
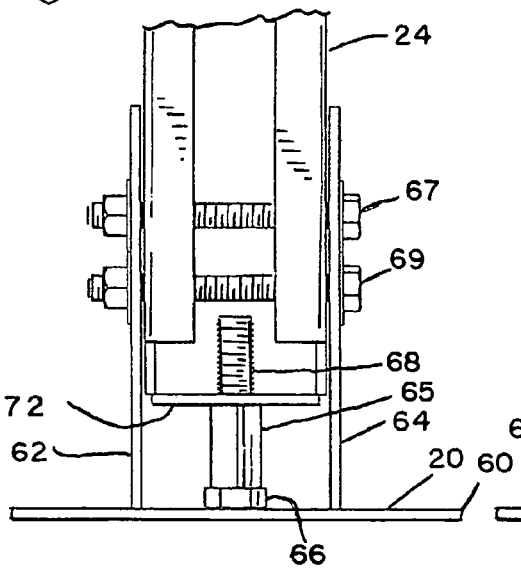
FIG. 8 is a detailed view of a lower elongated support received in a base support.
Figure 9:
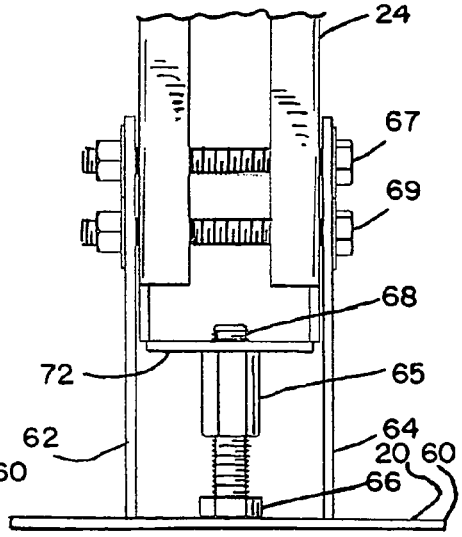
FIG. 9 is a detailed view of a lower elongated support received in a base support, with the lower elongated support at an elevated location.

Referring now to FIG. 8-FIG. 10, the connection of front left lower elongated support 24 with front left base support 20 is shown in detail. Front left base support 20 is seen to comprise a front left base support bottom section 60, having a left wall 62 and a right wall 64 extending transverse and upwardly there from. Front left base support is typically comprised of a steel fabricated unit but could be a single piece cast or otherwise assembled unit. Threaded height adjusting fastener 68 is seen to be comprised of an upper threaded portion and a base portion 66. Such threaded height adjusting fastener 68 is usually comprised of a machine bolt which extends through an opening in base portion 72 of front left lower elongated support 24. Adjusting nut 65 is seen to be threaded on the threaded portion of height adjusting fastener 68 to allow the base portion 72 of front left lower elongated support 24 to be raised to an extended position as shown in FIG. 9 to appropriately fit the combined front left lower elongated support 24 and upper elongated support 22 to meet the size needs of the final door opening 44 desired in the front of cooling tower component section 10. Further, upper threaded fastener 67 and lower threaded fastener 69 are seen to extend through slotted elongated opening 70 in right wall 64 of front left base support 20. Such bolts extend through aligned openings 74 in the bottom portion of side walls of front left lower elongated support 24.

Figure 11:
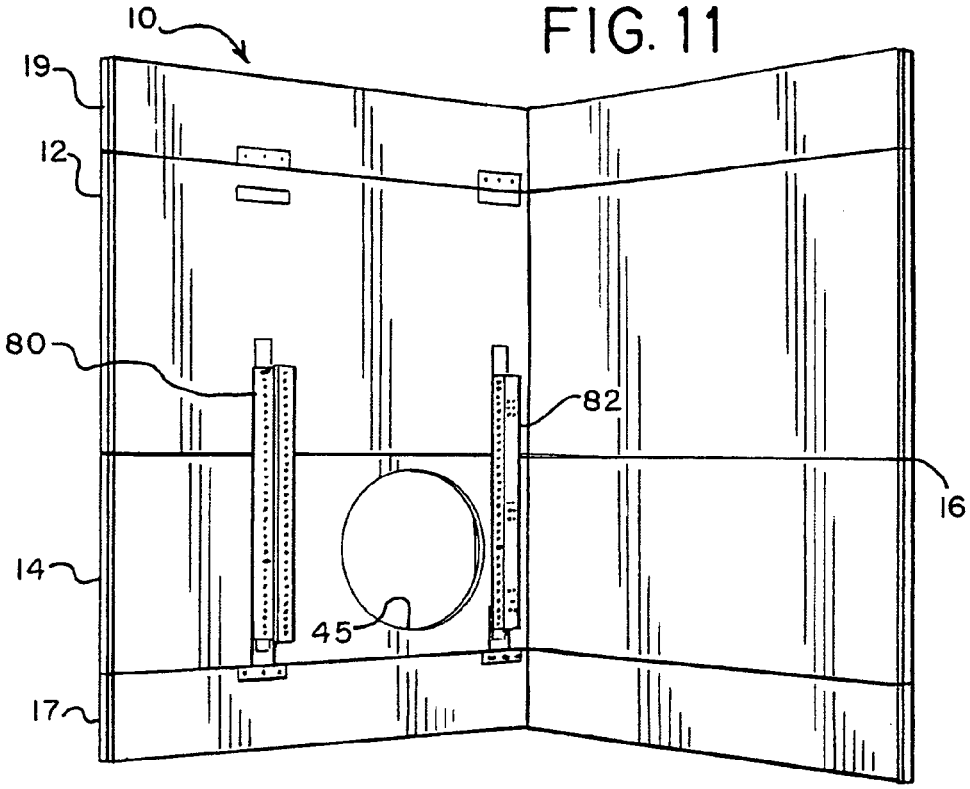
FIG. 11 is a perspective view of the inside of a cooling tower receiving a hinge support and a locking support.
Figure 12:
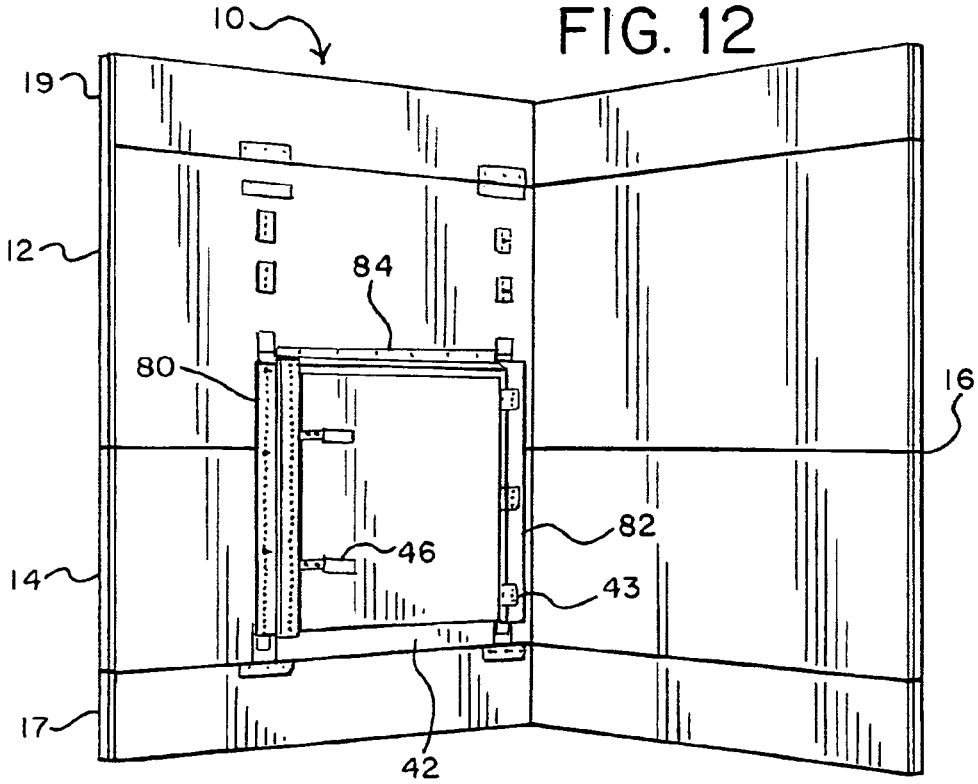
FIG. 12 is an inside view of a cooling tower having a complete hinge support, locking support, and rear top support and an access door installed.

Referring now to FIG. 11 and FIG. 12, an inside view of cooling tower component section 10 is provided wherein rear hinge elongated support 80 is affixed to an inside wall of upper section 12 and lower section 14. Such affixing is usually accomplished by bolts fitting through from the combined front right upper elongated support 32 and front right lower elongated support 34.

Similarly, rear locking elongated support 82 is affixed to an inside structural wall of upper section 12 and lower section 14. Such affixation is again typically accomplished by bolts extending through and engaging with the combined front left upper elongated support 22 and the front left lower elongated support 24. Hinges 43 are present on rear hinge elongated support 80 such that door 42 can be hung there from and locked or fixed in a closed position through the use of door locking handles 46.

What is claimed is:

1. An adjustable support assembly comprising:
a front left base support,
a front left lower elongated support,
a front left upper elongated support,
a front right base support,
a front right lower elongated support,
a front right upper elongated support,
a rear hinge support,
a rear locking support,
a structural wall,
and a door,
wherein the front left base support
is affixed to an outer surface of the structural wall,
the front left upper elongated support is affixed
to the outer surface of the structural wall,
the front left lower elongated support is affixed to the front left upper elongated support in a manner to allow lengthwise adjustment,
and a lower portion of the front left lower elongated support is affixed to the front left base support in a manner to allow lengthwise adjustment,
and wherein
the front right base support is affixed to the structural wall,
the front right upper elongated support is affixed to the structural wall,
the front right lower elongated support is affixed to the front right upper elongated upper support in a manner to allow lengthwise adjustment,
and a lower portion of the front right lower elongated support is affixed to the front right base support in a manner to allow lengthwise adjustment,
and wherein
the rear hinge support is affixed to an inner surface of the structural wall, and the rear locking support is affixed to an inner surface of the structural wall,
and a door opening is present in the structural wall between the rear hinge support and the rear locking support,
and the door is hung on the rear hinge support,
wherein the rear hinge support is affixed to the structural wall by holding components that extend through the structural wall to engage the front left lower elongated support,
and the rear backing support is affixed to the structural wall by holding components that extend through the structure wall to engage the front right lower elongated support.

2. The support assembly of claim 1
wherein the structural wall is part of a heat exchanger,
and the structural wall is comprised of an upper component and a lower component,
and wherein the door opening extends into both the upper component and the lower component.

3. The support assembly of claim 1
wherein the front left lower elongated support comprises two side structural sections
each having a plurality of openings,
and wherein the front left upper elongated support comprises two side structural sections each having a plurality of openings,
and at least one threaded fastener extending through aligned openings in the front left lower elongated support side structural sections and in the front left upper elongated support side structural sections to allow the front left lower elongated support and the front left upper elongated support to be secured to each other.

4. The support assembly of claim 1
wherein the front right lower elongated support comprises two side structural sections
each having a plurality of openings,
and wherein the front right upper elongated support comprises two side structural sections each having a plurality of openings,
and at least one threaded fastener extending through aligned openings in the front right lower elongated support side structural section and in the front right upper elongated support side structural sections to allow the front right lower elongated support and the front right upper elongated support to be secured to each other.

5. The support assembly of claim 1
wherein the structural wall is part of a heat exchanger,
and the structural wall is comprised of an upper component and a lower component,
and wherein the door opening extends into both the upper component and the lower component.

6. The support assembly of claim 1
wherein the front left lower elongated support comprises two side structural sections each having a plurality of openings,
and wherein the front left upper elongated support comprises two side structural sections each having a plurality of openings,
and at least one threaded fastener extending through aligned opening in the front left lower elongated support side structural section and in the front left upper elongated support side structural sections to allow the front left lower elongated support and the front left upper elongated support to be secured to each other.

7. The support assembly of claim 1 wherein the front right lower elongated support comprises two side structural sections each having a plurality of openings, and wherein the front right upper elongated support comprises two side structural sections each having a plurality of openings, and at least one threaded fastener extending through aligned openings in the front right lower elongated support side structural section and in the front right upper elongated support side structural sections to allow the front right lower elongated support and the front right upper elongated support to be secured to each other.

8. An adjustable support assembly comprising:

a front left base support, a front left lower elongated support, a front left upper elongated support, a front right base support, a front right lower elongated support, a front right upper elongated support, a rear hinge support, a rear locking support, a structural wall, and a door, wherein the front left base support is affixed to an outer surface of the structural wall, the front left upper elongated support is affixed to the outer surface of the structural wall, the front left lower elongated support is affixed to the front left upper elongated support in a manner to allow lengthwise adjustment, and a lower portion of the front left lower elongated support is affixed to the front left base support in a manner to allow lengthwise adjustment, and wherein the front right base support is affixed to the structural wall, the front right upper elongated support is affixed to the structural wall, the front right lower elongated support is affixed to the front right upper elongated upper support in a manner to allow lengthwise adjustment, and a lower portion of the front right lower elongated support is affixed to the front right base support in a manner to allow lengthwise adjustment, and wherein the rear hinge support is affixed to an inner surface of the structural wall, and the rear locking support is affixed to an inner surface of the structural wall, and a door opening is present in the structural wall between the rear hinge support and the rear locking support, and the door is hung on the rear hinge support, wherein the rear hinge support is affixed to the structural wall by holding components that extend through the structural wall to engage the front right lower elongated support, and the rear locking support is affixed to the structural wall by holding components that extend through the structural wall to engage the front left lower elongated support.

9. An adjustable support assembly comprising:

a front left base support, a front left lower elongated support, a front left upper elongated support, a front right base support, a front right lower elongated support, a front right upper elongated support, a rear hinge support, a rear locking support, a structural wall, and a door, wherein the front left base support is affixed to an outer surface of the structural wall, the front left upper elongated support is affixed to the outer surface of the structural wall, the front left lower elongated support is affixed to the front left upper elongated support in a manner to allow lengthwise adjustment, and a lower portion of the front left lower elongated support is affixed to the front left base support in a manner to allow lengthwise adjustment, and wherein the front right base support is affixed to the structural wall, the front right upper elongated support is affixed to the structural wall, the front right lower elongated support is affixed to the front right upper elongated upper support in a manner to allow lengthwise adjustment, and a lower portion of the front right lower elongated support is affixed to the front right base support in a manner to allow lengthwise adjustment, and wherein the rear hinge support is affixed to an inner surface of the structural wall, and the rear locking support is affixed to an inner surface of the structural wall, and a door opening is present in the structural wall between the rear hinge support and the rear locking support, and the door is hung on the rear hinge support, wherein the front left base support comprises a bottom section and two wall sections extending upwardly from the bottom section, a threaded fastener affixed to the bottom section and extending upwardly there from between the two wall sections and through an opening in the lower portion of the front left lower elongated support, an adjusting nut of the threaded fastener, the lower portion of the front left lower elongated structure being adjacent the adjusting nut, the adjusting nut by radial movement on the threaded fastener moving vertically along the threaded fastener and in turn vertically moving the front left lower elongated structure.

10. An adjustable support assembly comprising:

a front left base support, a front left lower elongated support, a front left upper elongated support, a front right base support, a front right lower elongated support, a front right upper elongated support, a rear hinge support, a rear locking support, a structural wall, and a door, wherein the front left base support is affixed to an outer surface of the structural wall, the front left upper elongated support is affixed to the outer surface of the structural wall, the front left lower elongated support is affixed to the from left upper elongated support in a manner to allow lengthwise adjustment, and a lower portion of the front left lower elongated support is affixed to the front left base support in a manner to allow lengthwise adjustment, and wherein the front right base support is affixed to the structural wall, the front right upper elongated support is affixed to the structural wall, the front right lower elongated support is affixed to the front right upper elongated upper support in a manner to allow lengthwise adjustment, and a lower portion of the front right lower elongated support is affixed to the front right base support in a manner to allow lengthwise adjustment, and wherein the rear hinge support is affixed to an inner surface of the structural wall, and the rear locking support is affixed to an inner surface of the structural wall, and a door opening is present in the structural wall between the rear hinge support and the rear locking support, and the door is hung on the rear hinge support, wherein the front right base support comprises a bottom section and two wall sections extending upwardly from the bottom section, a threaded fastener affixed to the bottom section and extending upwardly therefrom between the two wall sections and through an opening in the lower portion of the front right lower elongated support, an adjusting nut on the threaded fastener, the lower portion of the front right lower elongated structure being adjacent the adjusting nut, the adjusting nut by radial movement on the threaded fastener moving vertically along the threaded fastener and in turn vertically moving the front right lower elongated structure.

11. An adjustable support assembly comprising:

a front left base support, a front left lower elongated support, a front left upper elongated support, a front right base support, a front right lower elongated support, a front right upper elongated support, a rear hinge support, a rear locking support, a structural wall, and a door, wherein the front left base support is affixed to an outer surface of the structural wall, the front left upper elongated support is affixed to the outer surface of the structural wall, the front left lower elongated support is affixed to the front left upper elongated support in a manner to allow lengthwise adjustment, and a lower portion of the front left lower elongated support is affixed to the front left base support in a manner to allow lengthwise adjustment, and wherein the front right base support is affixed to the structural wall, the front right upper elongated support is affixed to the structural wall, the front right lower elongated support is affixed to the front right upper elongated upper support in a manner to allow lengthwise adjustment, and a lower portion of the front right lower elongated support is affixed to the front right base support in a manner to allow lengthwise adjustment, and wherein the rear hinge support is affixed to an inner surface of the structural wall, and the rear locking support is affixed to an inner surface of the structural wall, and a door opening is present in the structural wall between the rear hinge support and the rear locking support, and the door is hung on the rear hinge support, wherein the front left base support comprises a bottom section and two wall sections extending upwardly from the bottom section, and wherein each of the wall sections includes a slotted opening, and wherein the front left lower elongated support includes two side structural sections each having an opening thereon, and wherein a threaded fastener extends through the slotted openings in the wall sections of the front left base support and through the opening in each of the side structural sections of the front left lower elongated support.

12. An adjustable support assembly comprising:

a front left base support, a front left lower elongated support, a front left upper elongated support, a front right base support, a front right lower elongated support, a front right upper elongated support, a rear hinge support, a rear locking support, a structural wall, and a door, wherein the front left base support is affixed to an outer surface of the structural wall, the front left upper elongated support is affixed to the outer surface of the structural wall, the front left lower elongated support is affixed to the front left upper elongated support in a manner to allow lengthwise adjustment, and a lower portion of the front left lower elongated support is affixed to the front left base support in a manner to allow lengthwise adjustment, and wherein the front right base support is affixed to the structural wall, the front right upper elongated support is affixed to the structural wall, the front right lower elongated support is affixed to the front right upper elongated upper support in a manner to allow lengthwise adjustment, and a lower portion of the front right lower elongated support is affixed to the front right base support in a manner to allow lengthwise adjustment, and wherein the rear hinge support is affixed to an inner surface of the structural wall, and the rear locking support is affixed to an inner surface of the structural wall, and a door opening is present in the structural wall between the rear hinge support and the rear locking support, and the door is hung on the rear hinge support, wherein the front right base support comprises a bottom section and two wall sections extending upwardly from the bottom section, and wherein each of the wall section includes a slotted opening, and wherein the front right lower elongated support includes two side structural sections each having an opening therein, and wherein a threaded fastener extends through the slotted openings in the wall sections of the front right base support and through the opening in each of the side structural section of the front right lower elongated support.

13. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, wherein the front left base support is affixed to the outer surface of the structural wall, the front left upper elongated support is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support is fitted complementarily with the front right upper elongated upper support in a manner to allow lengthwise movement there between, and a lower portion of the front right lower elongated support is affixed to the front right base support in a manner to allow lengthwise movement of the front left lower elongated support, and wherein the rear hinge support is affixed to the inner surface of the structural wall, and the rear locking support is affixed to the inner surface of the structural wall, and a door opening is present in the structural wall between the rear hinge support and the rear locking support, and the door is hung on the rear hinge support, wherein the rear hinge support is affixed to the structural wall by holding components that extend through the structural wall to engage the front left lower elongated support, and the rear backing support is affixed to the structural wall by holding components that extend through the structural wall to engage the front right lower elongated support.

14. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, wherein the front left base support is affixed to the outer surface of the structural wall, the front left upper elongated support is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support is fitted complementarily with the front right upper elongated upper support in a manner to allow lengthwise movement there between, and a lower portion of the front right lower elongated support is affixed to the front right base support in a manner to allow lengthwise movement of the front left lower elongated support, and wherein the rear hinge support is affixed to the inner surface of the structural wall, and the rear locking support is affixed to the inner surface of the structural wall, and a door opening is present in the structural wall between the rear hinge support and the rear locking support, and the door is hung on the rear hinge support, wherein the rear hinge support is affixed to the structural wall by holding components that extend through the structural wall to engage the front right lower elongated support, and the rear locking support is affixed to the structural wall by holding components that extend through the structural wall to engage the front left lower elongated support.

15. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, P1 wherein the front left base support is affixed to the outer surface of the structural wall, the front left upper elongated support. is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support is fitted complementarily with the front right upper elongated upper support in a manner to allow lengthwise movement there between, and a lower portion of the front right lower elongated support is affixed to the front right base support in a manner to allow lengthwise movement of the front left lower elongated support, and wherein the rear hinge support is affixed to the inner surface of the structural wall, and the rear locking support is affixed to the inner surface of the structural wall, and a door opening is present in the structural wall between the rear hinge support and the rear locking support, and the door is hung on the rear hinge support, wherein the front left base support comprises a bottom section and two wall sections extending upwardly from the bottom section, a threaded fastener affixed to the front left base support bottom section and extending upwardly therefrom between the two wall sections and through an opening in the lower portion of the front left lower elongated support, an adjusting nut on the threaded fastener, the lower portion of the front left lower elongated structure being adjacent the adjusting nut, the adjusting nut by radial movement on the threaded fastener moving vertically along the threaded fastener and in turn vertically moving the front left lower elongated structure.

16. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, wherein the front left base support s affixed to the outer surface of the structural wall, the front left upper elongated support is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support is fitted complementarily with the front right upper elongated upper support in a manner to allow lengthwise movement there between, and a lower portion of the front right lower elongated support is affixed to the front right base support in a manner to allow lengthwise movement of the front left lower elongated support, and wherein the rear hinge support is affixed to the inner surface of the structural wall, and the rear locking support is affixed to the inner surface of the structural wall, and a door opening is present in the structural wall between the rear hinge support and the rear locking support, and the door is hung on the rear hinge support, wherein the front right base support comprises a bottom section and two wall sections extending upwardly from the bottom section, a threaded fastener affixed to the front right base support bottom sections and extending upwardly there from between the two wall sections and through an opening in the lower portion of the front right lower elongated support, an adjusting nut on the threaded fastener, the lower portion of the front right lower elongated structure being adjacent the adjusting nut, the adjusting nut by radial movement on the threaded fastener moving vertically along the threaded fastener and in turn vertically moving the front right lower elongated structure.

17. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, wherein the front left base support is affixed to the outer surface of the structural wall, the front left upper elongated support is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support is fitted complementarily with the front right upper elongated upper support in a manner to allow lengthwise movement there between, and a lower portion of the front right lower elongated support is affixed to the front right base support in a manner to allow lengthwise movement of the front left lower elongated support, and wherein the rear hinge support is affixed to the inner surface of the structural wall, and the rear locking support is affixed to the inner surface of the structural wall, and a door opening is present in he structural wall between the rear hinge support and the rear locking support, and the door is hung on the rear hinge support, wherein the front left base support comprises a bottom section and two wall section extending upwardly from the bottom section, and wherein each of the wall sections includes a slotted opening, and wherein the front left lower elongated support includes two side structural sections each having an opening thereon, and wherein a threaded fastener extends through the slotted openings in the wall sections of the front left base support and through the openings in each of the side structural sections of the front left lower elongated support.

18. An adjustable support assembly comprising:

a front left base support, a front left lower elongated support, a front left upper elongated support, a front right base support, a front right lower elongated support, a front right upper elongated support, a rear hinge support a rear locking support, a structural wall having an outer surface and an inner surface, and a door, wherein the front left base support is affixed to the outer surface of the structural wall, the front left upper elongated support is affixed to the outer surface of the structural wall, the front left lower elongated support is fitted complementarily with the front left upper elongated support in a manner to allow lengthwise movement therebetween, and a lower portion of the front left lower elongated support is affixed to the front left base support in a manner to allow lengthwise movement of the front left lower elongated support, and wherein the front right base support is affixed to the structural wall, the front right upper elongated support is affixed to the structural wall, the front right lower elongated support. is fitted complementarily with the front right upper elongated upper support in a manner to allow lengthwise movement there between, and a lower portion of the front right lower elongated support is affixed to the front right base support in a. manner to allow lengthwise movement of the front left lower elongated support, and wherein the rear hinge support is affixed to the inner surface of the structural wall, and the rear locking support is affixed to the inner surface of the structural wall, and a door opening is present in the structural wall between the rear hinge support and the rear locking support, and the door is hung on the rear hinge support, wherein the front right base support comprises a bottom section and two wall sections extending upwardly from the bottom section, and wherein each of the wall section includes a slotted opening, and wherein the front right lower elongated support includes two side structural sections each having an opening thereon, and wherein a threaded fastener extends through the slotted openings in the wall sections of the front right base support and through the opening in each of the side structural sections of the front right lower elongated support.

* * * * *